US006796089B1

(12) United States Patent
Campbell

(10) Patent No.: US 6,796,089 B1
(45) Date of Patent: Sep. 28, 2004

(54) BUILDING IN SUSPENSION

(76) Inventor: H. Fred Campbell, 4012 Hidden Woods Dr., Bloomfield Hills, MI (US) 48301

( * ) Notice: Subject to any disclaimer, the term of this patent is extended or adjusted under 35 U.S.C. 154(b) by 0 days.

(21) Appl. No.: 10/082,999

(22) Filed: Feb. 26, 2002

(51) Int. Cl.[7] ..... E02D 27/32

(52) U.S. Cl. ..... 52/168; 52/126.5; 52/299; 52/97

(58) Field of Search ..... 52/126.1, 126.5, 52/126.7, 295, 296, 97, 169.1, 168, 299; 4/487, 488

(56) References Cited

U.S. PATENT DOCUMENTS 3,237,352 A * 3/1966 Edwards ..... 52/60
RE26,056 E * 7/1966 Hickman ..... 52/94
3,450,192 A * 6/1969 Hay ..... 165/49
3,563,305 A * 2/1971 Hay ..... 165/49
3,616,583 A * 11/1971 Weineck ..... 52/168
3,645,057 A * 2/1972 Kaplan ..... 52/295
3,771,273 A * 11/1973 Brodie ..... 52/646
3,963,210 A * 6/1976 Macklin ..... 249/210
4,059,931 A * 11/1977 Mongan ..... 52/79.12
4,082,080 A * 4/1978 Pittinger ..... 126/714
4,282,693 A * 8/1981 Merklinger ..... 52/282.5
4,458,463 A * 7/1984 Behrend ..... 52/295
4,653,239 A * 3/1987 Randa ..... 52/91.3
4,785,593 A * 11/1988 Munoz, Jr. ..... 52/126.1
4,930,270 A * 6/1990 Bevacqua ..... 52/126.1
5,174,128 A * 12/1992 Bourne et al. ..... 62/373
5,720,135 A * 2/1998 Paquette ..... 52/174
6,161,362 A * 12/2000 Forbis et al. ..... 52/745.06
6,505,455 B1 * 1/2003 Georgeau ..... 52/746.11

* cited by examiner

*Primary Examiner*—Brian E. Glessner
(74) *Attorney, Agent, or Firm*—Reising, Ethington, Barnes, Kisselle, P.C.

(57) ABSTRACT

A building having columns supported on footings, and a flat roof supported on the columns. The roof contains a pool of water. Bolts are embedded in each footing. The columns are mounted on leveling plates which are vertically, adjustably mounted on the bolts. The roof is leveled by adjustment of the leveling plates.

1 Claim, 4 Drawing Sheets

BUILDING IN SUSPENSION

This invention relates generally to building structures and particularly to building structures for industrial or commercial use.

BACKGROUND AND SUMMARY OF THE INVENTION

The building structure of the present invention has universal application and may be built on any raw land, unused or formerly used, filled or contaminated and improved by suspending a dead level building above it which is of improved construction, faster and less costly to build, and without requiring penetration of the soil except for utilities.

Once a building site is selected, vegetation is removed, and the soil cut or filled to an established sub-grade elevation. A few inches of preferred 21A grade aggregate is preferably spread over the area where the building is to be erected, to facilitate squeezing out moisture and compacting the soil to develop optimum bearing capacity by heavy roller vibration, and/or dynamic compaction. Reinforced concrete column footings are then installed so that the concrete floor of the building will overlie the footings.

The footings preferably have extended high-strength anchor bolts that are threaded and double-nutted to suspend the entire structure several inches, sufficient to provide for any settlement adjustment and to maintain a level roof and facilitate the remainder of the construction procedure.

Upon completion of the column footings, the entire building site is graded to allow for the aggregate and also for an asphalt sub-flooring preferably at approximately the column footing elevations. The perimeter of the sub-flooring is preferably sloped for drainage.

The aggregate and the overlaid asphalt sub-flooring provide an impervious cap to seal off against contamination by preventing vapors and gases from entering the building and qualifying for approval by the Department of Environmental Quality (DEQ).

The asphalt sub-floor, before the finished concrete is overlaid, provides a useful storage and mobile working surface for receiving building materials and equipment which will be needed in the construction of the building. It therefore should not be necessary to store such materials and equipment on the bare ground outside of the building site where they will pick up mud and require to be cleaned before they can be installed in the building.

The building construction includes a roof which preferably has a flat horizontal or level surface surrounded by a border frame for the retention of water to a maximum depth of about three inches. Level roofs are required in many cities. Water is intended to be retained on this roof and by evaporation to have a cooling effect within the building and thereby reduce the load on air conditioning equipment in the building. A one-inch depth of water is sufficient for cooling by evaporation. An additional two inches of capacity is desirable to accommodate flash flood water which otherwise could produce back-up in undersized sewer systems.

It is an object of this invention to provide a building structure having the foregoing features and capabilities.

Other objects, features and advantages will become more apparent as the following description proceeds, especially when considered with the accompanying drawings and claims.

DETAILED DESCRIPTION OF THE PREFERRED EMBODIMENT

Figure 1:
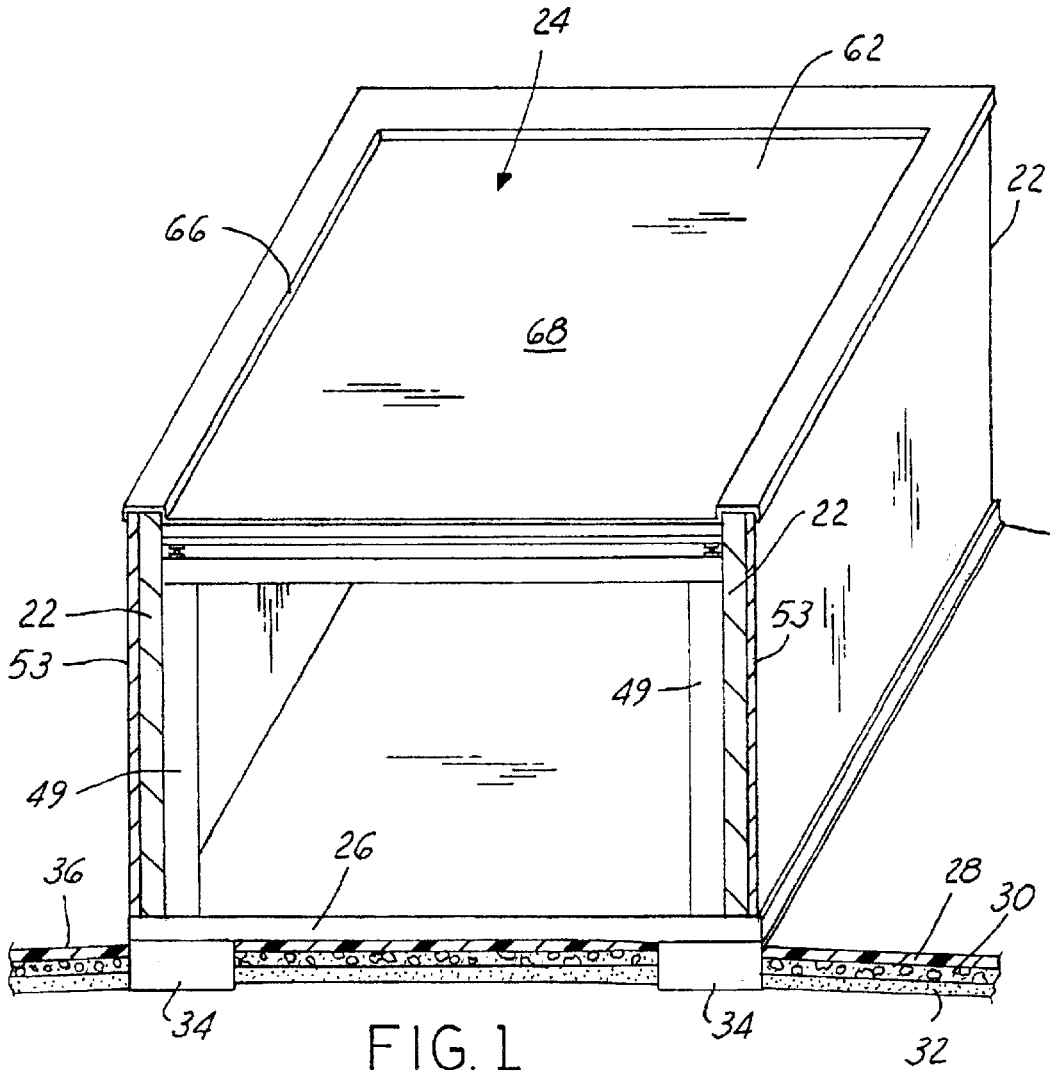
FIG. 1 is a semi-diagrammatic perspective view of a building structure embodying the invention with the front of the building broken away and in vertical section.
Figure 2:
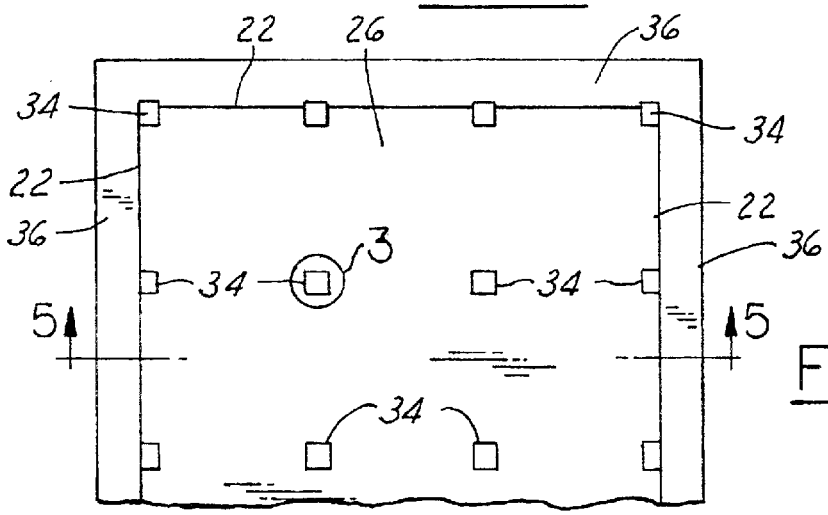
FIG. 2 is a semi-diagrammatic partial floor plan of the building structure in FIG. 1.
Figure 3:
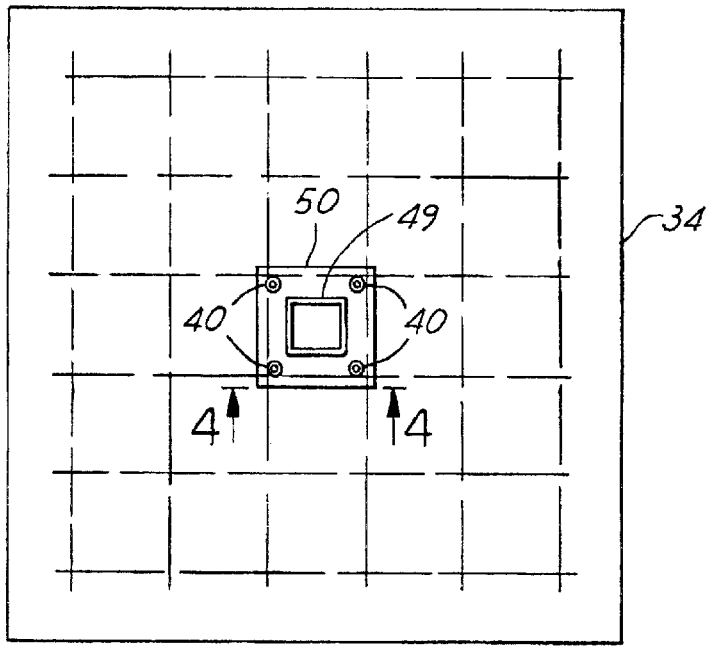
FIG. 3 is a plan view of a column footing within the circle 3 in FIG. 2, and taken on the line 3—3 in FIG. 4.
Figure 4:
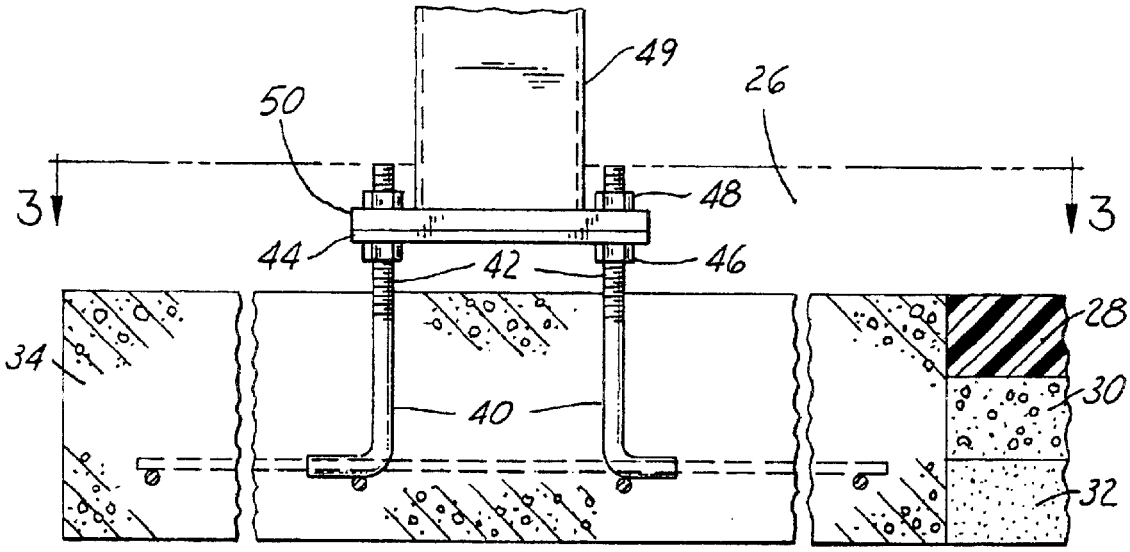
FIG. 4 is a sectional view taken on the line 4—4 in FIG. 3.
Figure 5:
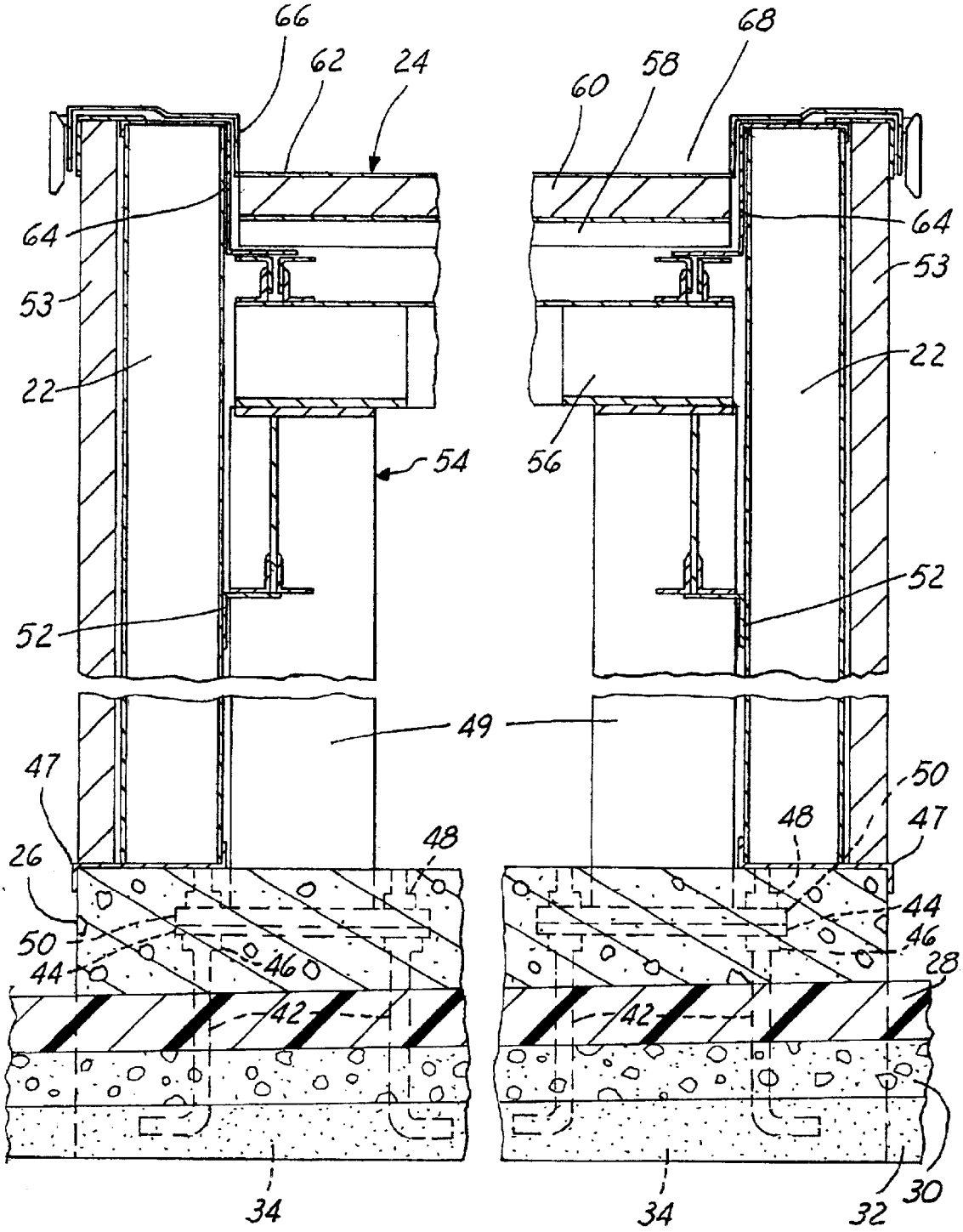
FIG. 5 is a vertical sectional view showing the columns and supporting structure for the roof of the building structure, as well as footings supporting the column, taken on the line 5—5 in FIG. 2.
Figure 6:
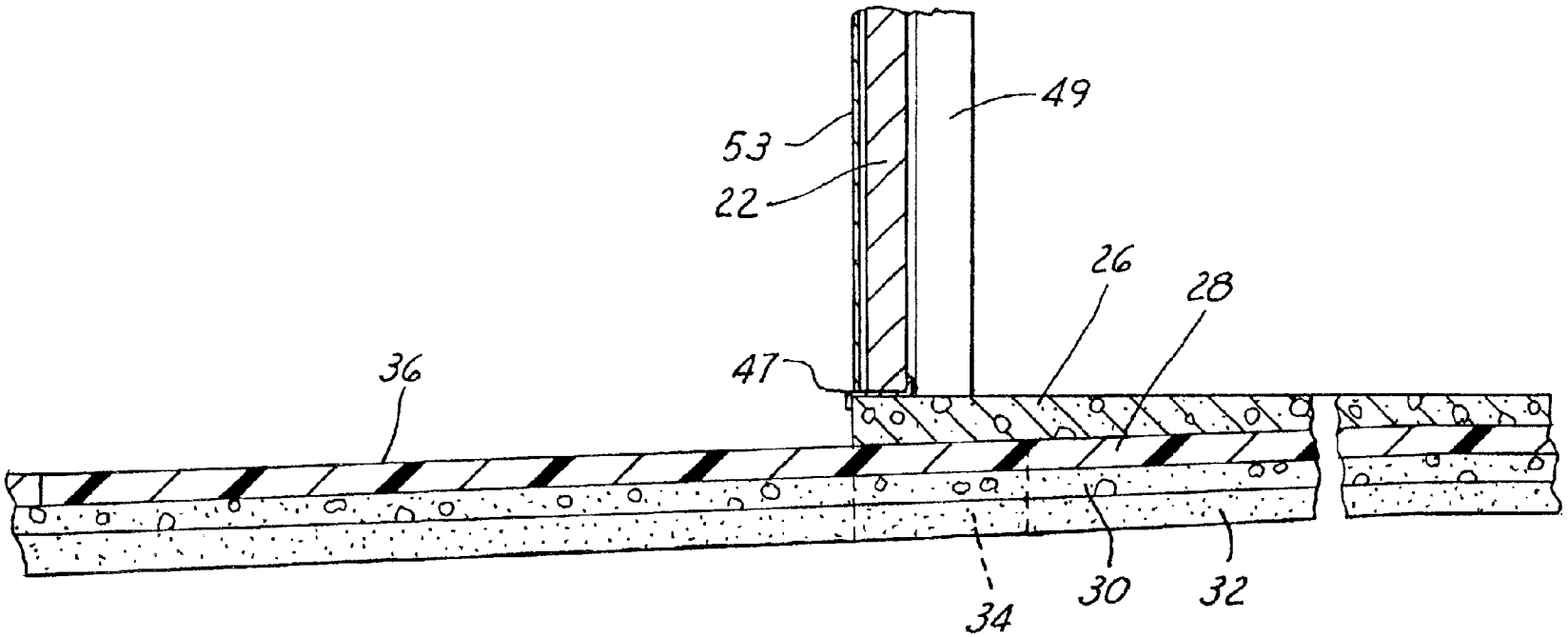
FIG. 6 is a view of a portion of FIG. 1 showing the sloped marginal portion of a subfloor of the building structure.

Referring now more particularly to the drawings, there is shown in FIG. 1 a building structure 20 having four side walls 22 and a roof 24. The building has a horizontal finished floor 26, which is preferably reinforced concrete, over a sub-floor 28 preferably made of asphalt A few inches of aggregate 30 are laid over compressed ground fill 32 used to establish a base. Column footings 34 are shown in the floor plan of FIG. 2 which include four corner footings, footings along the sides of the building between the corners and also footings within the area of the floor plan.

The sub-floor 28 within the walls of the building is horizontal or level except for the marginal edge portion 36 of the sub-floor which slopes downwardly and outwardly beyond the walls of the building in a laterally outward direction. The slope begins inside the building walls and extends to the outer edge of the marginal edge portion 36. This sloped marginal edge portion 36 extends around the entire periphery of the building and, prior to installation of the finished concrete floor 26, is intended to disperse water that may otherwise accumulate during the construction period and prevent water from entering the ground thus preventing frost. Before the finished concrete floor 26 is installed over the sub-floor 28, the sub-floor provides a convenient surface for the temporary storage of the various building components to be erected, and also for the equipment, including cranes etc. needed in the installation process.

Each footing 34 is a poured concrete pad which rests on the ground, extending downwardly through the asphalt sub-floor 28, the aggregate 30 and compressed fill 32. The top surfaces of the footings 34 are preferably about flush or level with the top surface of the sub-floor 28. A plurality of spaced apart anchor bolts 40 are embedded in each footing, having vertical portions which extend upwardly through the top surface of the footing with an upper threaded portion 42 exposed above the footing. A leveling plate 44 above each footing has holes through which the anchor bolts extend so that the leveling plate is adjustable vertically. Lower nuts 46 threaded on the bolts 40 support the leveling plate 44 at an adjusted level.

A vertical column 49 extends upwardly above each footing. Each column has a base plate 50 at the bottom supported on one of the leveling plates 44. The bolts 40 extend through holes in the base plate 50. Upper nuts 48 threaded on the bolts 40 clamp the base plates 50 down on the leveling plates 44.

All sides of the building are closed by the side walls 22 which are supported on the finished floor 26 by flashing 47 and secured to framing 54 as by metal connecting clips 52. Side facing panels 53 are secured to the outer sides of the walls 22.

The roof 24 is supported on the framing 54 including joists 56. The joists 56 are secured to the columns 49. The roof 24 includes a flat metal deck 58 with an overlay of a layer of insulation 60 covered with a liquid impervious sheet or membrane 62 made of a suitable material such as a fiber reinforced plastic. A framing plate 64 extends around all sides of the deck 58 and insulation layer 60. The marginal portions of the sheet 62 extend upwardly along the plate 64 and over the tops of the walls 22 to provide a border frame 66 which extends upwardly preferably about three (3) inches above the top surface of the sheet 62 so that the border frame 66 defines a shallow pool 68 for the capture and retention of water.

The top surface 62 of the pool 68 which is the bottom of the pool, is horizontal, and it is made horizontal by vertical adjustment of the columns 49 which in turn is accomplished by adjusting the leveling plates 44 vertically and clamping the leveling plates in adjusted position by the nuts 46 and 48. Normally the pool 68 will be filled with approximately one (1) inch of water which cools the building by evaporation. The water level is maintained by a suitable control (not shown). The additional two (2) inches of capacity of the pool is desirable to accommodate flash flood water which otherwise might produce over-flooding or back-up in undersized sewer systems.

It will be noted that the anchor bolts 40 projecting upwardly from the footings 34 are completely covered by the finished concrete floor 26. If any of the bolts 40 should happen to project above the concrete floor 26, they may be cut off flush with the top surface of the floor.

What is claimed is:

1. In a building structure, a plurality of spaced apart footings, a plurality of columns, a base plate on a lower end of each of said columns, a column support for each of said columns supporting each of said columns on a respective one of said footings, a roof structure supported on said columns, said roof structure having a flat, generally horizontal, upwardly facing surface surrounded by a border frame, said flat, generally horizontal, upwardly facing surface and said border frame defining a pool for containing water to a depth of approximately one inch or more, and water filling said pool to a depth of approximately one inch or more, wherein the column support for each of said columns comprises a vertically adjustable column-supporting leveling plate above each of said footings, a plurality of bolts having lower portions embedded in, and vertical upper portions projecting above, each of said footings, first nuts threaded on the upper portions of said bolts, said leveling plates being supported on said first nuts, said base plates being supported on said respective leveling plates, and second nuts threaded on the upper portions of said bolts and clamping said base plates down on said leveling plates and said leveling plates down on said first nuts, wherein the roof structure is capable of adjustment to make the upwardly facing surface horizontal by vertical adjustment of the columns which can be accomplished by vertical adjustment of said leveling plates effected by vertical adjustment of said first nuts, and wherein each of said footings has a lower portion embedded in a sub-floor and an upper portion embedded in a finished floor extending over said sub-floor.

* * * * *